US008590589B2

(12) United States Patent
Carmichael et al.

(10) Patent No.: US 8,590,589 B2
(45) Date of Patent: Nov. 26, 2013

(54) VACUUM DRUM FOR LABELLING MACHINES

(75) Inventors: James Frederick Robertson Carmichael, Kendal (GB); Marco Domeniconi, Via Variano (IT)

(73) Assignee: Sidel Holdings & Technology S.A., Pully (CH)

( * ) Notice: Subject to any disclaimer, the term of this patent is extended or adjusted under 35 U.S.C. 154(b) by 274 days.

(21) Appl. No.: 12/863,315

(22) PCT Filed: Feb. 26, 2008

(86) PCT No.: PCT/EP2008/052284
§ 371 (c)(1),
(2), (4) Date: Jul. 16, 2010

(87) PCT Pub. No.: WO2009/106128
PCT Pub. Date: Sep. 3, 2009

(65) Prior Publication Data

US 2011/0048629 A1 Mar. 3, 2011

(51) Int. Cl.
*B65C 3/08* (2006.01)

(52) U.S. Cl.
USPC .... 156/448; 156/556; 156/566; 156/DIG. 98; 156/DIG. 9; 156/DIG. 14; 156/DIG. 34; 156/DIG. 37

(58) Field of Classification Search
USPC ..... 156/215, 256, 285, 448, 556, 566, 156/583.3, DIG. 8, DIG. 9, DIG. 14, DIG. 37, 156/DIG. 34; 492/33–39; 29/895.2, 895.23; 264/509, 571, 101
See application file for complete search history.

(56) References Cited

U.S. PATENT DOCUMENTS

| | | | | |
|---|---|---|---|---|
| 3,661,625 | A | 5/1972 | La Mers | |
| 5,160,570 | A * | 11/1992 | Dickey | 156/448 |
| 5,401,353 | A * | 3/1995 | Westbury et al. | 156/566 |
| 5,964,974 | A | 10/1999 | Hinton | |
| 6,898,821 | B1 * | 5/2005 | Bisbee et al. | 15/353 |

FOREIGN PATENT DOCUMENTS

WO WO 2006051292 A1 * 5/2006

* cited by examiner

*Primary Examiner* — Christopher Schatz
(74) *Attorney, Agent, or Firm* — Dickstein Shapiro LLP

(57) ABSTRACT

The present invention relates to an improved vacuum drum for handling labels in labelling machines to be used for labelling containers such as bottles. In particular, the present invention relates to a vacuum drum system (1) for labelling machines, comprising a vacuum drum (2) rotatably supported on a non-rotating base (12), a feeding and cutting group (4) for the labels and a gluing group (5) having a gluing drum for the label, characterized in that it comprises a suction system (3) for withdrawing hot glue filaments originating from the glued label assisted by air jets emitted from the drum surface, the said suction system (3) being positioned adjacent to and downstream the gluing drum of the said gluing group (5), along the direction of rotation of the said vacuum drum (2). A method of operating the said system is also claimed.

20 Claims, 6 Drawing Sheets

VACUUM DRUM FOR LABELLING MACHINES

The present invention relates to an improved vacuum drum for handling labels in labelling machines to be used for labelling containers such as bottles.

Labelling machines for gluing labels and transferring them onto the surface of containers are known and widespread used. In these machines the containers are carried by a carrousel and come into contact with a labelling unit. The labelling unit comprises a so called "vacuum drum" that receives a label strip from a roll feeding group, cuts the label at the appropriate length, glue the label by means of appropriate means, such as a gluing drum, spray and injector systems or the like, and finally transfer the label to the container. During these handling operations, the label is retained on the vacuum drum by means of vacuum applied on the label. To this purpose, the surface of the vacuum drum comprises a plurality of orifices that are in communication with a vacuum source.

The known machines have a serious drawback. As the glue is viscous, glue filaments are formed between the glued surface of the label and the gluing drum. These filaments are then dragged by the label during the rotation of the vacuum drum, so that the glue can soil the whole unit, making the cleaning operations difficult and lengthy.

The problem faced by the present invention is to provide a system that overcomes the above drawback.

This problem is solved by a vacuum drum system for a combined blow off-suction of the glue filament such as outlined in the annexed claims, whose wording is integral part of the present description.

Further features and advantages of the present invention will be better understood from the description of a preferred embodiment, which is given below by way of a non-limiting illustration, with reference to the following figures.

Figure 2:
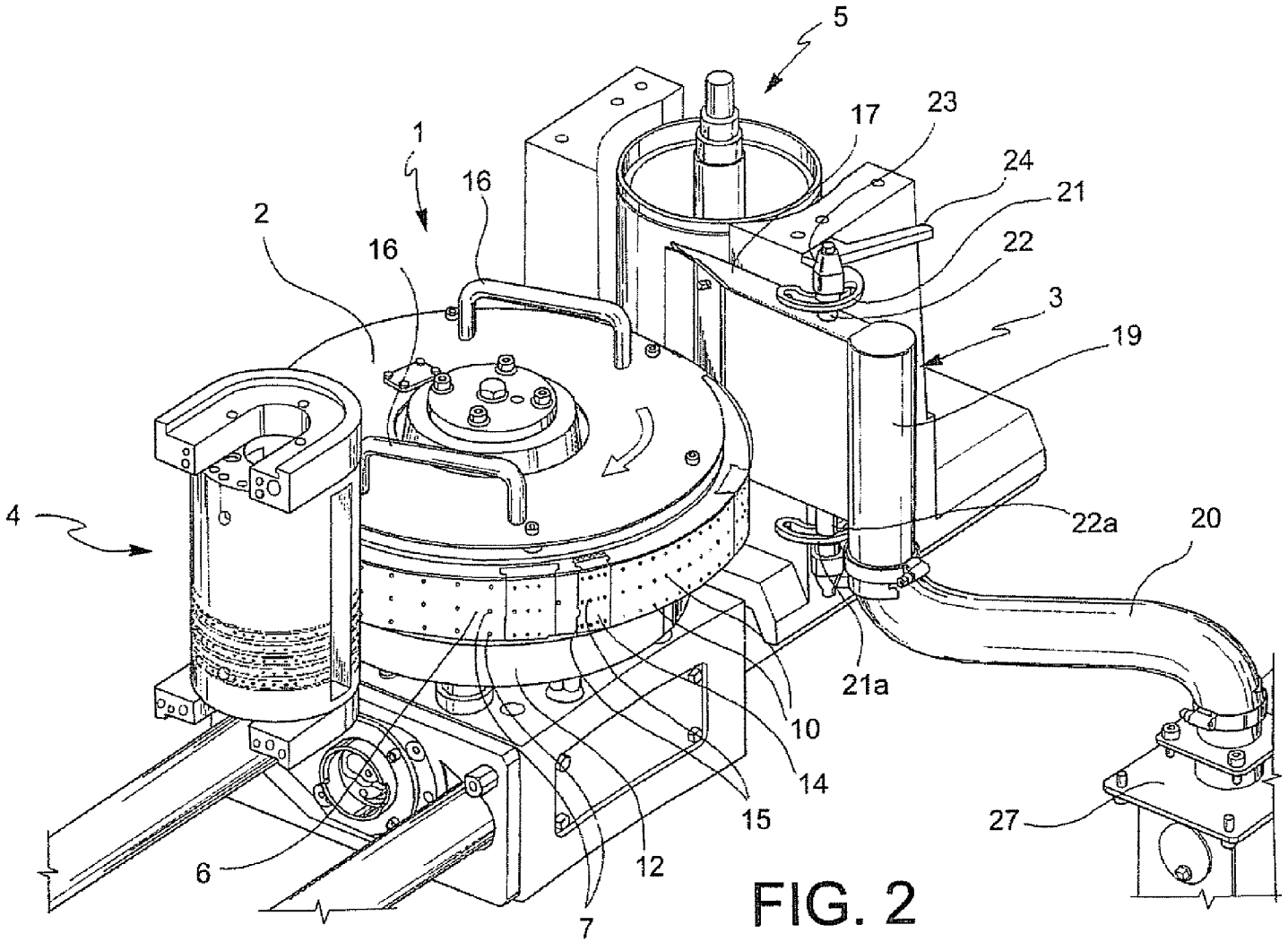
FIG. 2 is a perspective view of a labelling unit comprising the system of FIG. 1.

With reference to the figures, the vacuum drum system of the invention, wholly indicated with the numeral 1, comprises a vacuum drum 2 and a suction system 3 for the glue filaments. As shown in FIG. 2, the vacuum drum system 1 is positioned in a labelling unit that also comprises a feeding and cutting group 4 as well as a gluing group 5 in juxtaposed relationship. The feeding and cutting group 4 provides for feeding a label strip from a label roll (not shown) and cutting the label to the desired length. The gluing group 5 comprises gluing means such as a gluing drum for gluing the label that is previously fed and retained by the vacuum drum. Spray and injector systems can also be used as gluing means. Downstream from the gluing group 5, the label arrives to the label transferring station (not shown) that provides for transferring the label to the container that is synchronously driven by the main carrousel. Feeding and cutting group 4, gluing group 5, as well as label transferring station are conventional and are not subject of the present invention, so that they will not be described in more details.

The vacuum drum 2 is independently driven by a motor, such as a brushless motor or the like, placed below the drum or is driven by the carrousel motor through suitable gears.

The top surface of the vacuum drum 2 comprises handle means 16 to facilitate its removal or mounting during the normal cleaning operations or any other technical intervention.

Figure 5:
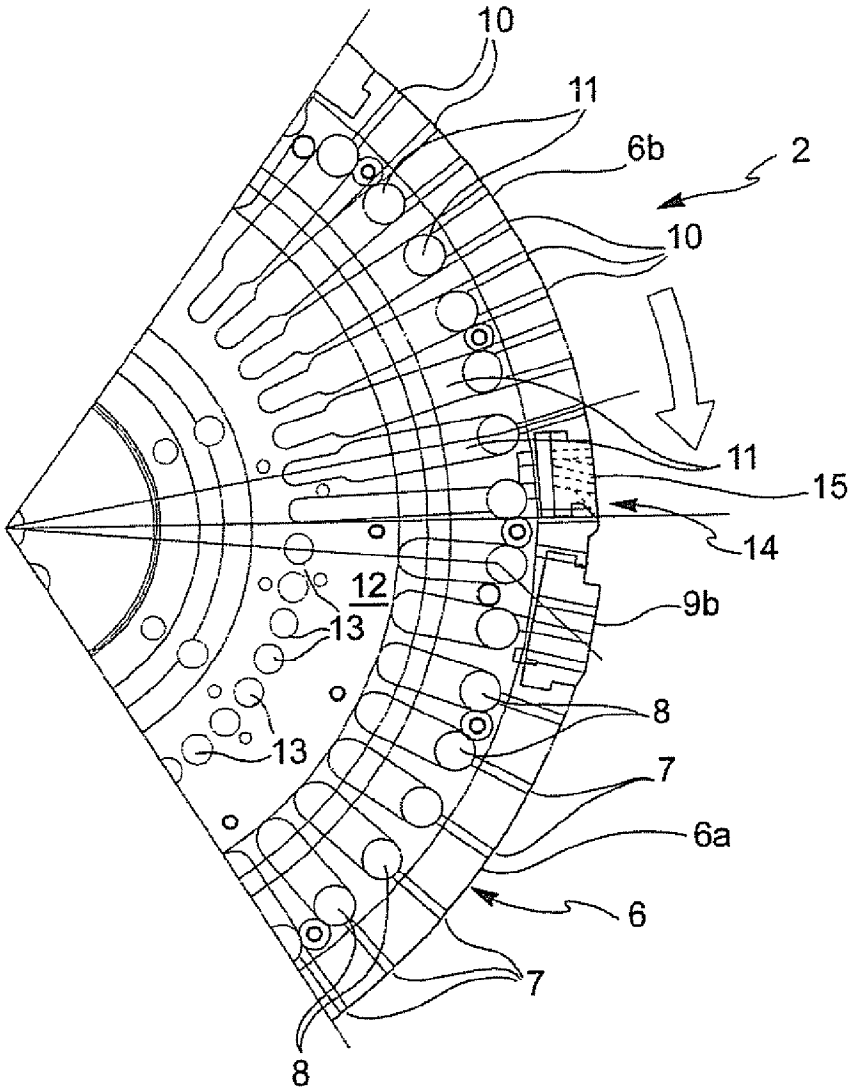
FIG. 5 is a top sectional view of the vacuum drum of the invention.

The vacuum drum 2 comprises peripherally a lateral surface 6 to engage with the label. The lateral surface comprises at least one first section 6*a* having a plurality of through holes 7 in communication with internal passages 8 (FIG. 5). These passages 8 can be connected to a vacuum source by means of suitable orifices or manifolds present on the non-rotating base 12 on which the vacuum drum is supported and rotated. In other words, when the rotating vacuum drum 2 reaches a position where the said passages 8 are in alignment with said orifices or manifolds, vacuum is applied on the surface of the said first section 6*a*.

In a preferred embodiment, three first sections 6*a* are present on the vacuum drum 2, as shown in the figures. Nevertheless, a different number of first sections 6*a* can be provided, depending on the capacity of the machine and mainly on the length of the labels, which means that more or less than three first sections 6*a* can be provided.

In the embodiment shown in the figures, two pads 9*a*, 9*b* are disposed at the two extremities of the at least one first section 6*a* of the lateral surface 6. This is normally called the "transfer zone", wherein the label slides so that glue contamination is a problem. These pads 9*a*, 9*b* are slightly protruding from the lateral surface 6 and have the function to engage with the leading and the trailing ends of the label, respectively. To this purpose, the pads 9*a*, 9*b* present a plurality of through holes in communication with the said passages 8 for the vacuum.

While the lateral surface 6 of the vacuum drum is generally made of nickel plated aluminium (stainless steel can also be used in special applications), the pads 9*a*, 9*b* are preferably made of plastics material and are removable in order to be substituted when necessary.

It should be understood that in different embodiments, the pads 9*a*, 9*b* can be simply replaced by a prolongation of the said first section 6*a* of the lateral surface 6 and thus can be integral with such a surface.

Figure 1:
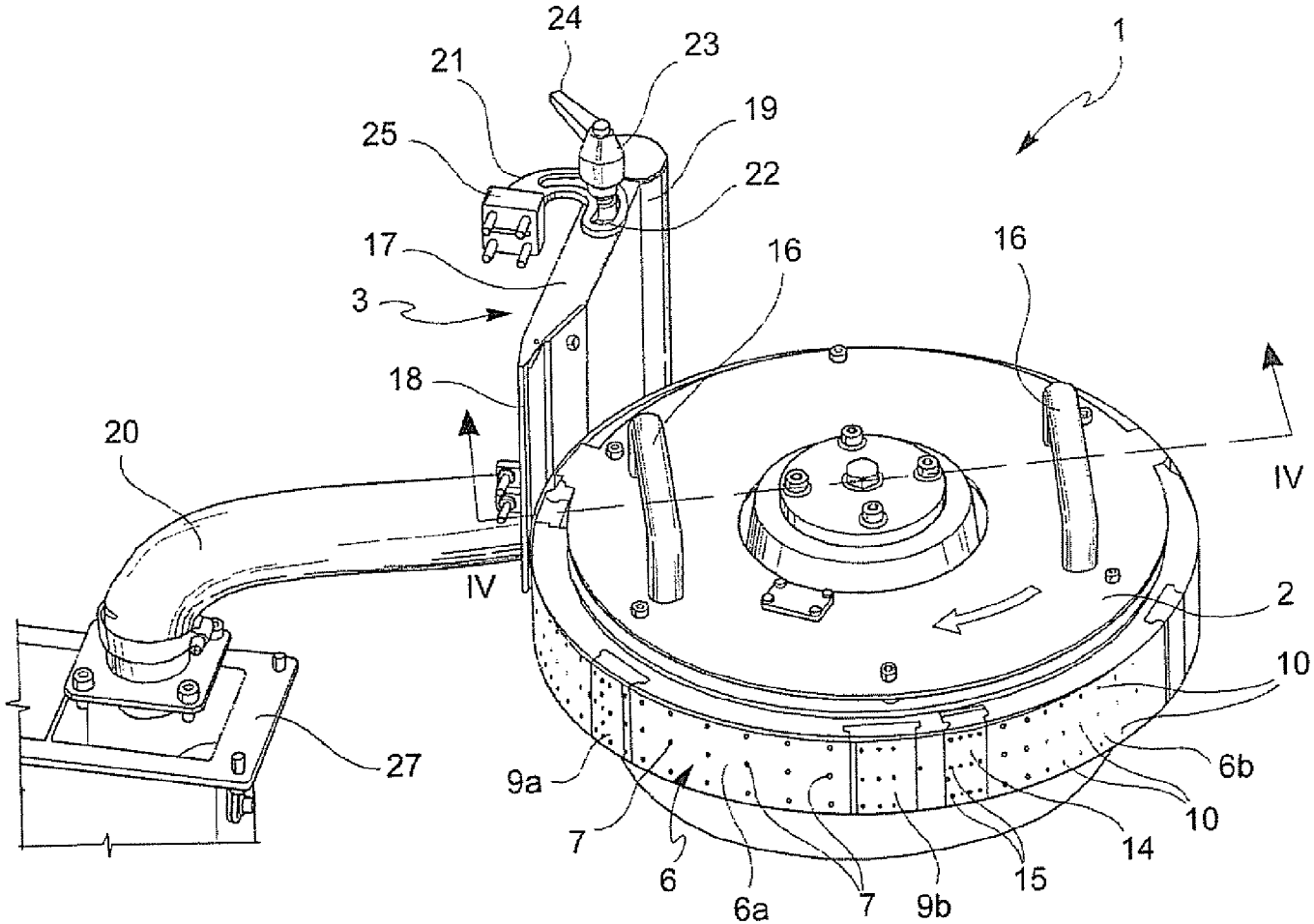
FIG. 1 is a perspective view of the vacuum drum system of the invention.

The lateral surface 6 of the vacuum drum 2 also comprises at least one second section 6*b* adjacent to said at least one first section 6*a* in an upstream relationship with this latter with respect to the direction of rotation of the vacuum drum 2 (see arrow in FIG. 1). One second section 6*b* for each first section 6*a* is provided, so that according to the preferred embodiment, three second sections 6*b* are present.

The number of the said first and second sections 6*a*, 6*b* will depend on the length of the labels. The longer are the labels the less sections 6*a*, 6*b* are provided.

The said at least one second section 6*b* (that is usually called "inter pad" zone) is provided with a plurality of through holes 10. The said through holes 10 are in communication with elongated passages 11 that are positioned internally to the vacuum drum 2. The elongated passages 11 extend to a series of orifices 13 located on the non-rotating base 12, to which they can be put into communication as the rotating vacuum drum 2 reaches a position where the elongated passages 11 are in alignment with said orifices 13. The orifices 13 are on their turn in communication with means (not shown), such fan means or a compressed air source or the like, in order to provide a stream of air under pressure from the said through holes 10 when the said elongated passages 11 are in alignment with said orifices 13.

The elongated passages 11 are also in flow communication with a second series of orifices to apply vacuum, which are present on the base 12, along a more external circumference and offset with respect to the said orifices 13. This is because the through holes 10 can serve different functions depending on the position of the vacuum drum 2 relative to the base 12, as will be explained herein after.

A sub-section 14 of the second section 6*b* is provided. According to the embodiment shown in the figures, this sub-section 14 is made up of a separate element, but it should be understood that it is equally foreseen that the sub-section 14 is integral with the second section 6*b*.

The sub-section 14 is close to the pad 9*b* that receives the trailing end of the label and is provided with a plurality of through holes 15.

Figure 3:
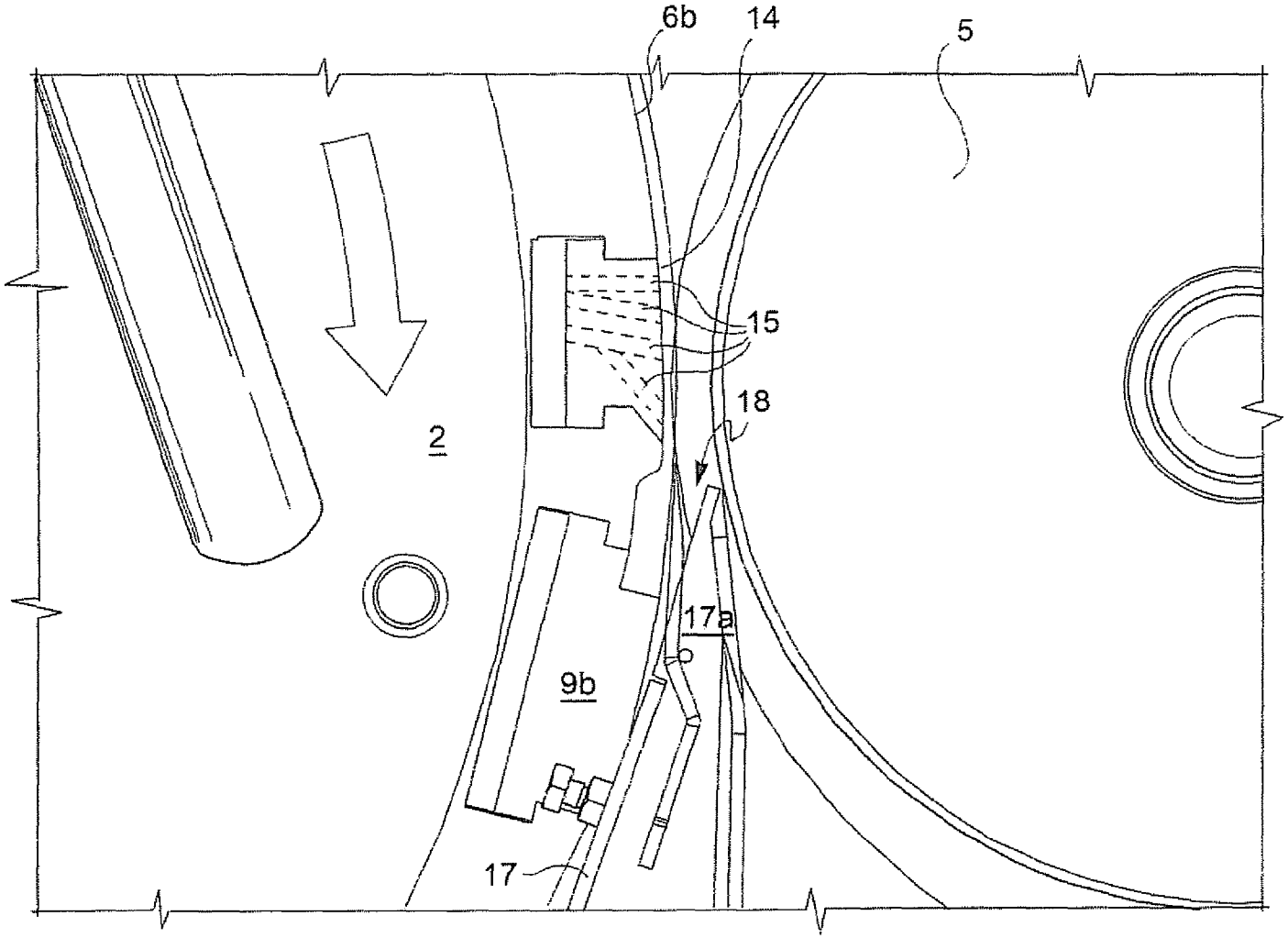
FIG. 3 is a top plan view of a particular of the system of FIG. 1.
Figure 4:
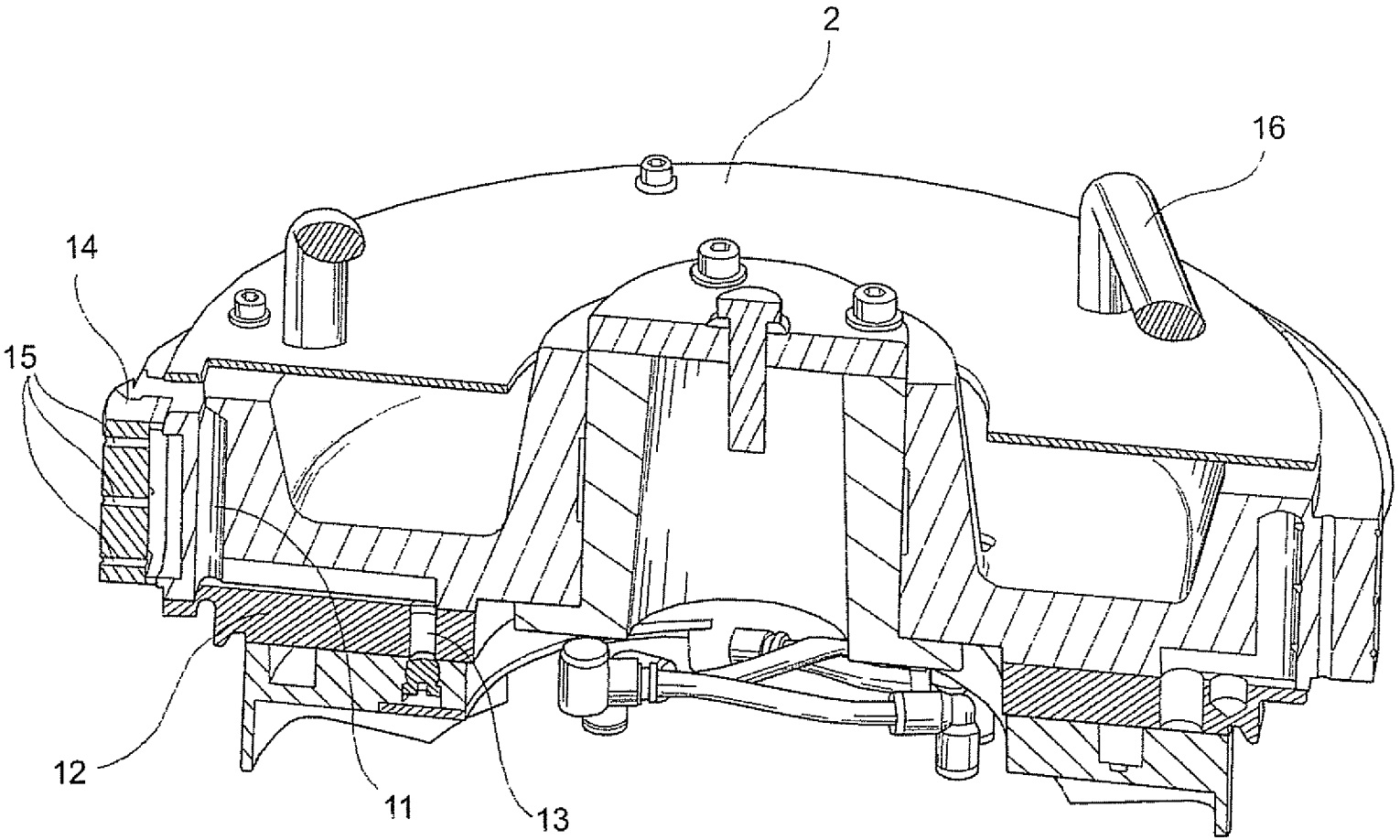
FIG. 4 is a cross section perspective view along the line IV-IV of FIG. 1.

As shown in FIGS. 3 and 5, the said through holes 15 are all or in part slanting relative to the radius of the drum, so that they are facing toward the direction of rotation of the vacuum drum 2. More in detail, according to a preferred embodiment of the invention there are four vertical series of through holes 15: the first vertical series, starting from the pad 9*b*, originate internally as a branch of the second series and is very slanting. The second and the third series of through holes 15 are less slanting, while the fourth series is substantially radial.

The said through holes 15 are also in communication, by means of respective elongated passages 11, with the said orifices 13 for blowing air under pressure.

The suction system 3 will be now described.

The suction system 3 comprises a suction head 17. In the shown example, the suction head 17 is made up of a substantially flat, hollow body tapered at one end, wherein it terminates with a slot or any other inlet aperture 18. A substantially flat passage 17*a* is thus defined inside the suction head 17.

At the opposite end, the suction head 17 is connected to a manifold means 19 that is on its turn in flow communication with a suction pipe 20. In the exemplary figure, the manifold means 19 is substantially cylindrical and closed at its top end, while the suction pipe 20 is connected at the bottom end of the manifold means 19. However, it should be understood that any other shape or arrangement of the different parts of the suction system can be provided as well without departing from the scope of the present invention.

The suction pipe 20 is made up of a material that is resistant to high temperature, as the sucked glue is very hot.

The suction head 17 is positioned vertically along a direction that is substantially tangential to the vacuum drum 2, with the tapered side looking at the drum so that the inlet aperture 18 is at a short distance from the vacuum drum 2 surface and faces against the direction of rotation of the drum.

In order to be adjustable, the suction head 17 is hinged to guiding means 21 that preferably comprise an arcuate slot wherein a pin 22 can run. The pin 22 is threaded and is in engagement with a bolt 23 that presses against the guiding means 21. Preferably, the bolt 23 is a self-locking bolt. By loosening the bolt 23, moving the pin 22 in the guiding means 21 and tightening the bolt 23 again, it is possible to adjust the position of the suction head 17 relative to the vacuum drum 2. Handle means 24 can be provided to the bolt 23 to facilitate its operation.

The guiding means 21 can be coupled, through suitable fixing means 25 such as a screwed plaque, to the gluing group 5. Analogously, guiding means 21*a* and a pin 22*a* can be provided at the bottom end of the suction head 17.

Figure 6:
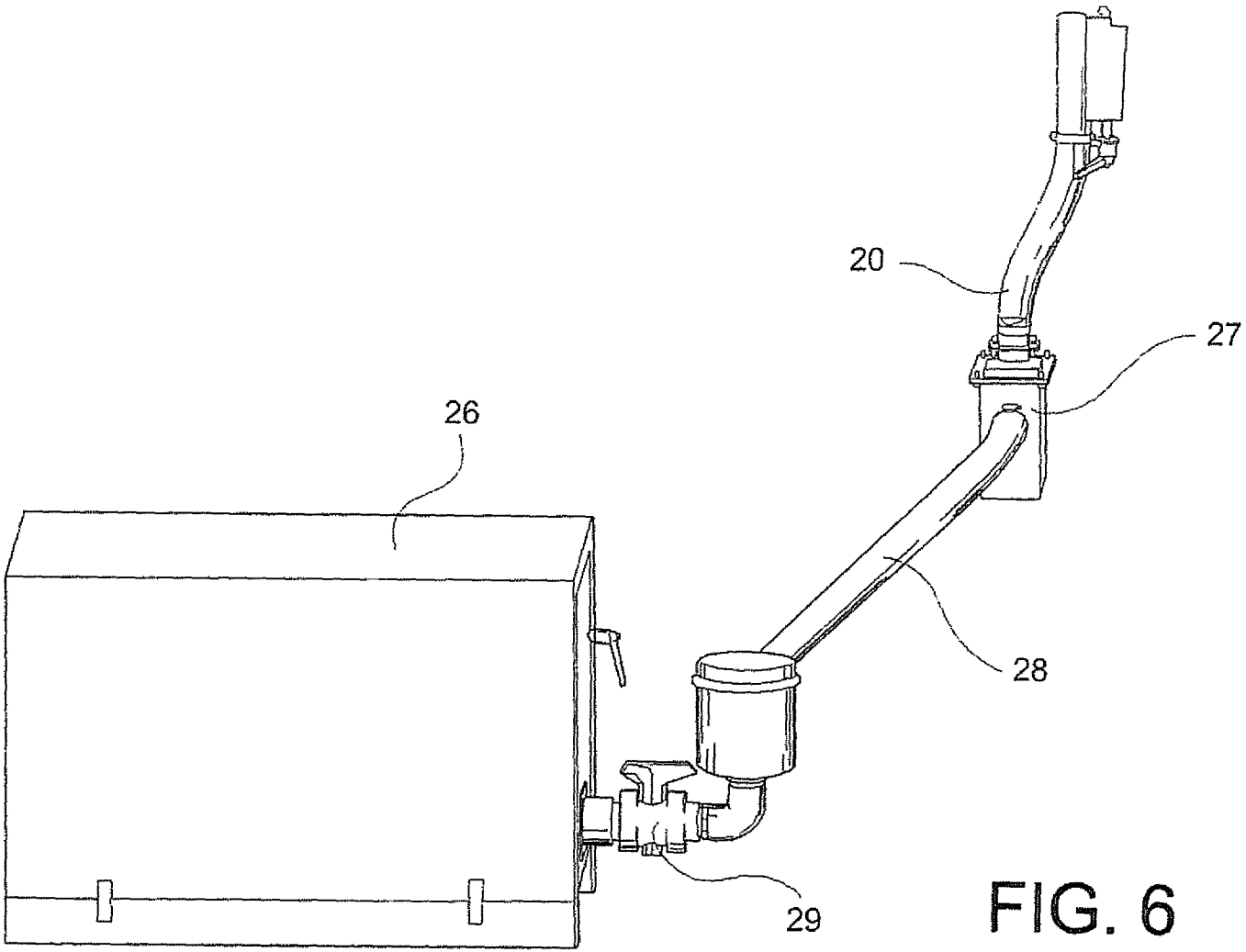
FIG. 6 is a simplified perspective view of the suction system for the glue filaments according to the invention.

The suction pipe 20 is connected to suction means (FIG. 6) through collecting means 27, such as a collecting box, for the sucked glue. The collecting means 27 are linked by a connecting pipe 28 to the said suction means 26, the said connecting pipe 28 being intercepted by valve means 29 to adjust the vacuum. The valve means 29 can be omitted once the set up of the system is completed or can be replaced by different air flow control means, apt to tune the air flow that is withdrawn by the suction head 17.

A filter (not shown) is preferably interposed up stream the valve means 29, to intercepts glue residues that could possibly pass the said collecting means 27 and contaminate the valve means.

The said collecting means 27 are removable, so that they can be cleaned from time to time.

The operation of the inventive vacuum drum system 1 will now be described.

The vacuum drum 2 works conventionally by rotating in the direction indicated by an arrow in the drawings, so that it first receives the label strip and cuts it to the desired label length at the feeding and cutting group 4 and then retains the label by vacuum on its lateral surface 6. While still rotating the vacuum drum 2, the retained label passes through the gluing group 5. At this stage, glue filaments are normally formed between the label and the gluing drum. Just downward the gluing group 5 there is positioned the suction head 17, so that, when the sub-section 14 of the second section 6*b* of the vacuum drum lateral surface 6 reaches a position wherein it is in alignment with the inlet aperture 18, at the same time the through holes 15 are put into communication with the orifices 13 connected to fan means or compressed air source through the said elongated passages 11, which are in alignment with said orifices 13. A flow of air under pressure thus exits the through holes 10, 15, so that the glue filament is blown away before contact with the surface of the first section 6*a*. Concomitantly, the suction head 17—that at this point is aligned with the sub-section 14 as said above—withdraws the glue filaments and send them to the collecting means 27. It should be noted that, when the vacuum drum 2 is in a different rotational position than the one just described, the elongated passages 11 are put into communication with the more external series of orifices to which vacuum is applied, so that in the other positions of the vacuum drum 2 the through holes 10, 15 act to apply vacuum.

The labelling operation is completed by transferring the label to the container at the station downstream the suction system 3. In such a way, the drawback of contaminating the machine surfaces with the glue filaments is completely avoided.

Thus, the invention also encompasses a method for removing glue filaments from a label during the labelling operation of containers in a labelling machine, comprising the steps of:

providing a vacuum drum system 1 according to the present invention and;

removing the glue filament from the label by a combined blow off of the glue filament from the vacuum drum 2 lateral surface 6 and suction of the said glue filament by a suction system 3, the said combined blow off-suction action creating a substantially straight air flow from the lateral surface 6 of the vacuum drum 2 to the internal passage 17*a* of the suction head 17 of the said suction system 3.

The advantages of the vacuum drum system 1 according to the invention are thus apparent.

The cleaning operation of the machine is greatly improved.

Furthermore, the suction system 3 and the collecting means 27 are easily removable in order to clean them properly.

The suction head 17 is adjustable relative to the vacuum drum 2, so that the better conditions for use are found depending on the different applications.

It will be appreciated that only a particular embodiment of the present invention has been described herein, to which those skilled in the art will be able to make any and all modifications necessary for its adjustment to specific applications, without however departing from the scope of protection of the present invention as defined in the annexed claims.

The invention claimed is:

1. Vacuum drum system for labeling machines, comprising a vacuum drum rotatably supported on a non-rotating base, a feeding and cutting group for feeding and cutting a plurality of labels, a gluing group having a hot gluing means for applying hot glue to a leading end and a trailing end of the labels, and a suction system for withdrawing hot glue filaments from the vacuum drum, the suction system being separate from the vacuum drum and having an inlet aperture positioned externally to and opposed to a lateral surface of the vacuum drum at a position immediately adjacent to and downstream the gluing group, along the direction of rotation of the vacuum drum.

2. Vacuum drum system according to claim 1, wherein at least one first section and at least one second section are defined on the lateral surface of the vacuum drum, the at least one second section comprising a plurality of through holes in communication with elongated passages in the rotating vacuum drum, the elongated passages extending to orifices situated on the non-rotating base on which the vacuum drum is rotatably supported, said orifices being connected with means to blow air under pressure from said through holes when the elongated passages are in alignment with said orifices.

3. Vacuum drum system according to claim 2, wherein the at least one second section of the lateral surface of the vacuum drum further comprises a sub-section provided with a plurality of through holes that are all or in part slanting relative to the radius of the vacuum drum, so that they are facing toward the direction of rotation of the vacuum drum.

4. Vacuum drum system according to claim 3, wherein the sub-section of the at least one second section is adjacent to the at least one first section and the plurality of through holes is arranged in four vertical series of through holes, the first vertical series is slanted and branches from the second series, the second series and the third series are less slanted than the first series and the fourth series is substantially radial to the vacuum drum.

5. Vacuum drum system according to claim 3, wherein the sub-section is integral with the at least second section of the lateral surface of the vacuum drum.

6. Vacuum drum system according to claim 3, wherein the at least one first section is provided with a plurality of through holes in communication with internal passages that can be connected to a vacuum source by means of suitable orifices or manifolds present on the non-rotating base on which the vacuum drum is rotatably supported, when the rotating vacuum drum reaches a position where the passages are in alignment with said orifices or manifolds.

7. Vacuum drum system according to claim 6, wherein a first pad and a second pad, provided with a plurality of through holes in communication with the passages for the vacuum, are disposed at two extremities of the at least one first section of the lateral surface, the first pad and the second pad protruding slightly from the lateral surface for engaging the leading end and the trailing end of the label, respectively.

8. Vacuum drum system according to claim 7, wherein the said sub-section of the at least one second section of the lateral surface of the vacuum drum is adjacent to the second pad.

9. Vacuum drum system according to claim 2, wherein the elongated passages are also in flow communication with a second series of orifices to apply vacuum, that are present on the base, along a more external circumference and offset with respect to the orifices.

10. Vacuum drum system according to claim 3, wherein the suction system further comprises a suction head terminating with the inlet aperture, a passage being defined inside the suction head.

11. Vacuum drum system according to claim 10, wherein the suction head is connected to a manifold means, which is on its turn in flow communication with a suction pipe.

12. Vacuum drum system according to claim 10, wherein the suction head is positioned vertically along a direction that is substantially tangential to the vacuum drum, the inlet aperture being positioned at a short distance from the vacuum drum surface and facing against the direction of rotation of the vacuum drum, so that, when the vacuum drum is in a rotational position where the orifices are aligned with the elongated passages, the through holes of the sub-section of the at least one second section of the lateral surface and the inlet aperture are substantially aligned.

13. Vacuum drum system according to claim 10, wherein the suction head is hinged to at least one guiding element shaped in such a way to allow adjustment of the position of the suction head relative to the vacuum drum.

14. Vacuum drum system according to claim 13, wherein the guiding element has an arcuate slot wherein a pin can run, the pin being threaded and being in engagement with a bolt that presses against the guiding element to lock or unlock the suction head.

15. Vacuum drum system according to claim 14, wherein the bolt is a self-locking bolt having a handle.

16. Vacuum drum system according to claim 13, wherein the suction head is hinged to two guiding elements, the guiding elements being coupled to the gluing group.

17. Vacuum drum system according to claim 11, wherein the suction pipe is connected to suction means through collecting means for the sucked glue, the collecting means being linked by a connecting pipe to the suction means.

18. Vacuum drum system according to claim 17, wherein the connecting pipe is intercepted by valve means to adjust the vacuum.

19. Vacuum drum system according to claim 18, wherein a filter is provided upstream the valve means.

20. Vacuum drum system according to claim 17, wherein the collecting means is removable.

* * * * *